United States Patent [19]

Hosoya et al.

[11] 4,253,038

[45] Feb. 24, 1981

[54] LIGHT SOURCE EXCITED BY HIGH FREQUENCY FOR ZEEMAN EFFECT ATOMIC ABSORPTION ANALYSIS

[75] Inventors: Akira Hosoya; Kunihiro Maeda; Keiichi Kuniya, all of Hitachi; Sadami Tomita, Katsuta; Kohnosuke Ohishi, Mito, all of Japan

[73] Assignee: Hitachi, Ltd., Japan

[21] Appl. No.: 919,610

[22] Filed: Jun. 27, 1978

[30] Foreign Application Priority Data

Aug. 10, 1977 [JP] Japan ..... 52-95132

[51] Int. Cl.[3] ..... H01J 1/14

[52] U.S. Cl. ..... 313/346 R; 313/161; 313/209; 313/311; 356/313; 356/314

[58] Field of Search ..... 356/311, 313, 314; 313/346 R, 161, 311, 209; 315/267

[56] References Cited

U.S. PATENT DOCUMENTS

| | | | |
|---|---|---|---|
| 3,725,716 | 4/1973 | Yamasaki | 313/218 X |
| 3,732,454 | 5/1973 | Okagaki et al. | 313/346 R X |
| 4,100,446 | 7/1978 | Harada | 356/311 X |

*Primary Examiner*—Saxfield Chatmon, Jr.
*Attorney, Agent, or Firm*—Craig & Antonelli

[57] ABSTRACT

A light source is disclosed which can be used in atomic absorption analysis using the Zeeman effect. In operation, an external magnetic field is applied to the hollow cathode of the light source to cause the Zeeman-splitting of an emission line from the cathode material. The hollow cathode is made of a ferromagnetic metal as which is the element of interest for analysis and a metal for reducing the magnetic shield of the externally applied magnetic field by the ferromagnetic metal so that the external magnetic field effectively acts on the hollow portion of the cathode to provide the desired Zeeman-splitting. The hollow cathode is designed such that the product of the saturation flux densities of the cathode materials and the volume thereof is equal to or smaller than $0.2(\mathrm{Wb{\cdot}m}) \times 10^{-6}$. The emission line from the cathode material is produced by excitation from a high frequency power supply, the power supply being connected to the cathode and the anode of the light source.

22 Claims, 10 Drawing Figures

LIGHT SOURCE EXCITED BY HIGH FREQUENCY FOR ZEEMAN EFFECT ATOMIC ABSORPTION ANALYSIS

The present invention relates to an atomic absorption analysis using the Zeeman effect. One desirable application of the present invention is a hollow cathode used in such an analysis for Fe, Ni and/or Co.

Today, atomic absorption spectrometry based on the ability of vaporized atoms to absorb radiation at certain characteristic wavelengths is widely used for quantitative microanalysis of metals in various fields. A problem of background correction has developed with the increased use of such spectrometry. As a result, atomic absorption analysis using the Zeeman effect has come into wide use.

The Zeeman effect atomic absorption analysis is based on the Zeeman effect, i.e. the phenomenon that an emission line is split by the application of a magnetic field. The use of the split Zeeman components enhances the sensitivity of analysis. The magnetic field may be applied to an atomizer containing a sample to be analyzed. A method in which the magnetic field is applied to a burner type atomizer has a problem that a magnet must be placed near the heated portion of the atomizer. A method in which the magnetic field is applied to a graphite cell atomizer has a problem of poor reproducibility. One of the present inventors, Kahnssuhe Ohishi has proposed, in U.S. patent application Ser. No. 871,807 filed Jan. 24, 1978 and entitled "Spectral Source, particularly for Atomic Absorption Spectrometry", a method in which the magnetic field is applied to a hollow-cathode discharge tube as a light source. This method can be employed by use of high frequency discharge and is considered to be an optimum technique.

However, when it is desired to analyse Fe, Ni or Co by using the method in which the external magnetic field is applied to the hollow-cathode discharge tube, the ferromagnetic metal such as Fe, Ni or Co to be used as the cathode material has the effect of shielding the externally applied magnetic field so that a magnetic field having a sufficient strength is not provided in the hollow or discharge portion of the cathode. As a result, there was a problem that little or no Zeeman-splitting takes place, thereby remarkably deteriorating the accuracy of measurement. The fact that the externally applied magnetic field cannot be utilized with high efficiency due to the magnetic shielding effect, would give rise to the inconvenience that a magnet of large size must be used to provide a sufficient field strength or a large drive current is required in the case of using an electromagnet.

An object of the present invention is to provide a hollow cathode capable of being used in atomic absorption analysis using the Zeeman effect, in which the externally applied magnetic field can effectively act on the hollow portion of the cathode to provide the desired Zeeman-splitting.

The present invention will be described in detail in conjunction with the accompanying drawings, in which.

Figure 3:
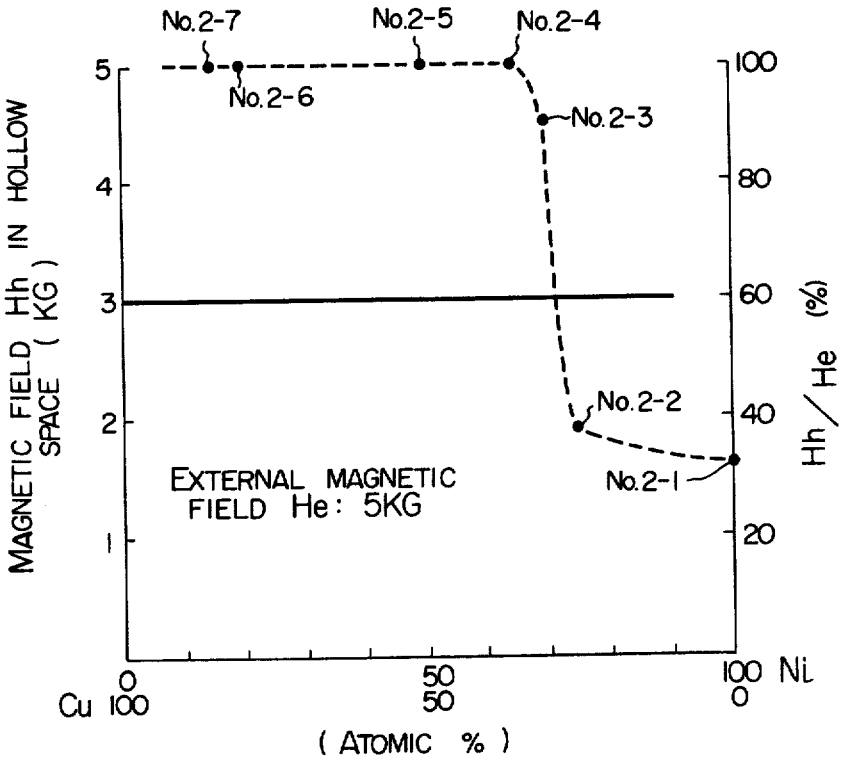
Figure 4:
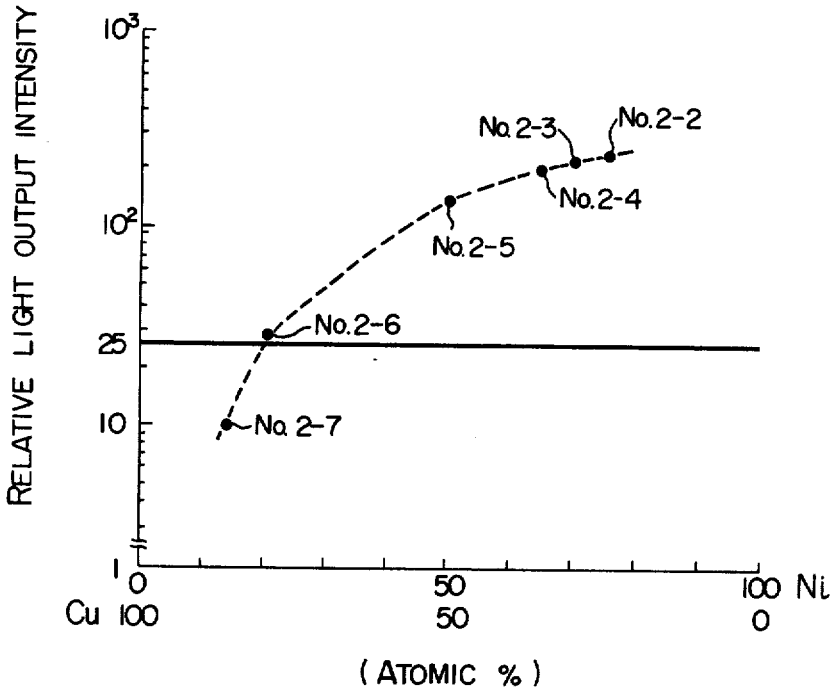
Figure 5:
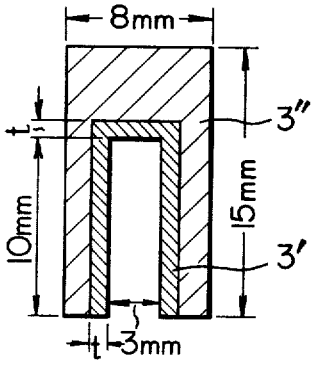
Figure 6:
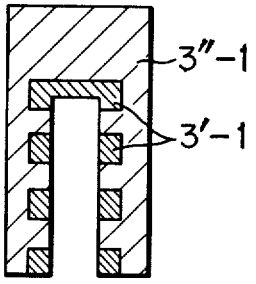
Figure 7:
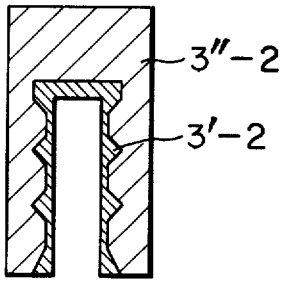
Figure 8:
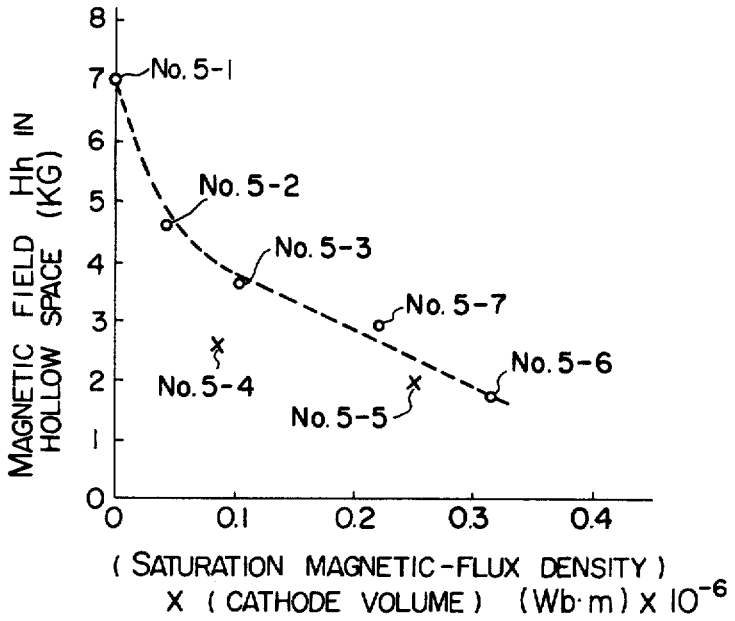
Figure 9A:
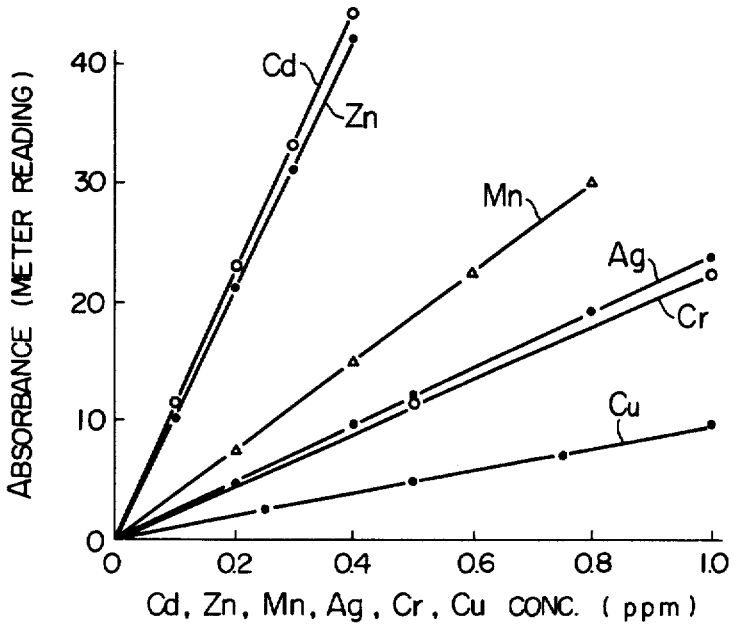
Figure 9B:
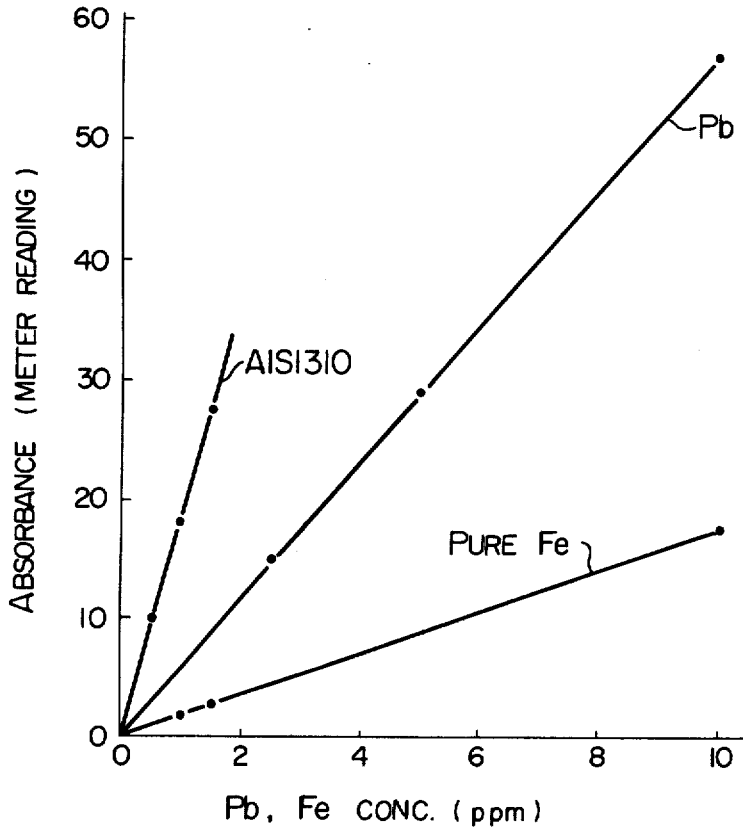

FIG. 3 graphically shows the experimental relationship between the quantity of Cu and the magnetic field intensity in hollow space for hollow cathodes of Ni-Cu alloy when an external magnetic field of 5 KG is applied;

FIG. 4 graphically shows the experimental relationship between the quantity of Cu and the light output intensity of Ni emission line for hollow cathodes of Ni-Cu alloy when a high frequency power input of 20 W is applied;

FIG. 5 is a cross-sectional view showing the structure and dimension of the cathode samples shown in Table II;

FIGS. 6 and 7 are cross-sectional views showing the modifications of the cathode structure shown in FIG. 5;

FIG. 8 graphically shows the experimental relationship between the product of saturation magnetic-flux density and cathode volume and the magnetic field intensity in hollow space for hollow cathodes of various metals; and FIGS. 9A and 9B graphically show the experimental relationships between absorbance and the quantity of element for various cathodes.

Figure 1:
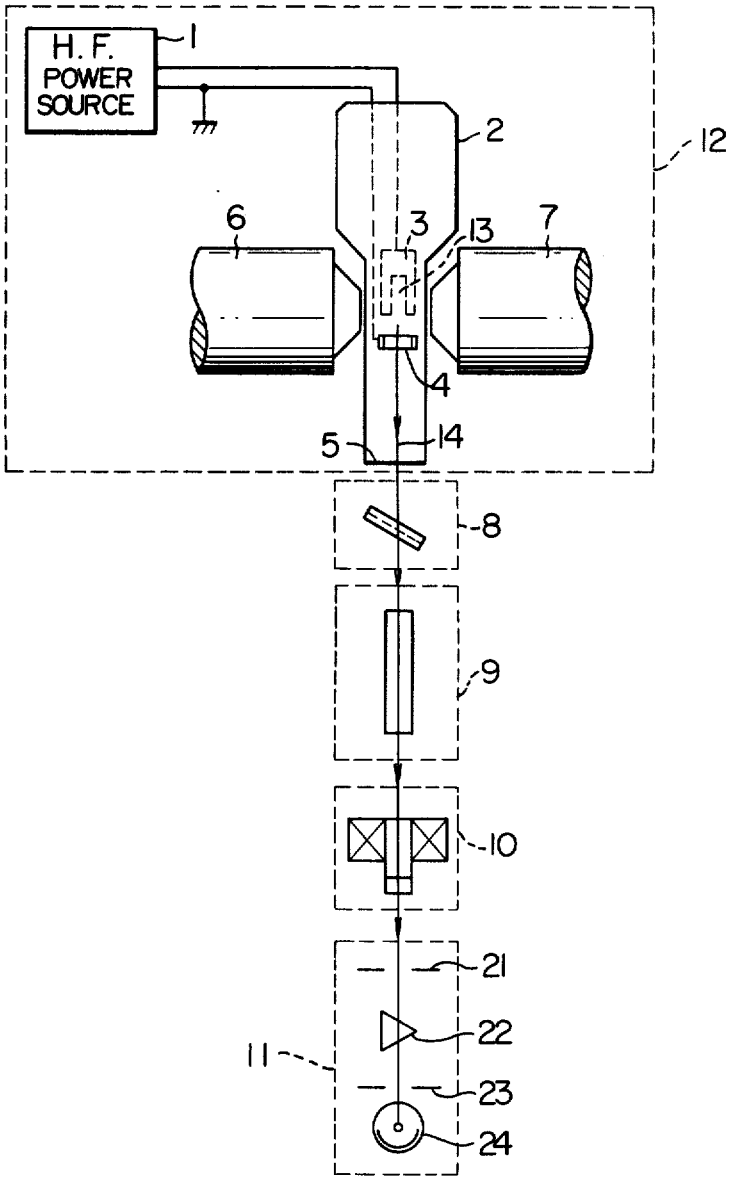
FIG. 1 shows a schematic diagram of a Zeeman effect atomic absorption analyzer to which the present invention can be applied.

In FIG. 1 showing a Zeeman effect atomic absorption analyzer to which the present invention can be applied, a light source section 12 comprises a tube 2 filled with a discharge maintaining inert gas such as neon, argon, helium or krypton of about 2 to 10 Torr. The tube 2 includes a window 5 from which an emission line produced by the discharge is extracted. A hollow cathode 3 and a ring-shaped anode 4 are arranged opposite to each other within that portion of the tube 2 in which the tube diameter is narrowed.

The inner surface of a hollow portion 13 of the hollow cathode 3 is made of a metal which generates the spectra of the element in interest for analysis. Supply lines of a high frequency power from a high frequency power source 1 are connected to the cathode 3 and the anode 4 respectively and one of the supply lines is grounded. Magnets 6 and 7 are disposed for applying a magnetic field to a space where vaporized atoms produced by a high frequency discharge between the cathode 3 and the anode 4 exist.

The inert gas in the tube 2 is ionized by the high frequency discharge and the produced ions impinge upon the inner surface of the hollow portion 13 of the cathode 3 so that the cathode material is spattered. Spattered atoms are excited into illumination by the applied high frequency power. Since the magnetic field is formed by the magnets 6 and 7, the emission line is split into Zeeman components, i.e. $\pi$ and $\sigma\pm$ components by the Zeeman effect. When observation is made in a direction perpendicular to the magnetic field, the $\pi$ component is a linearly polarized light having its oscillation plane parallel to the field and the $\sigma\pm$ components are linearly polarized lights having their oscillation planes perpendicular to the field.

Zeeman light 14 passes through the light extracting window 5 of the tube 2 and the polarization degree thereof is compensated for by a polarization compensator 8. When the light is passed in vaporized atoms of a sample to be analyzed within an atomizer 9, the light is absorbed in correspondence to the quantity of the element in interest for analysis in the sample. Non-absorbed light is passed through a polarizer arrangement 10 from which only the spectral line of the $\pi$ component is passed and is detected by a detector section 11 including a monochrometer having a first slit 21, a prism 22 and a second slit 23 and further including a photomultiplier 24. Thus, the quantity of the element in interest for analysis in the sample can be measured.

However, when it is desired to analyse Fe, Ni or Co by use of the analyzer having the above-described arrangement, the ferromagnetic metal of Fe, Ni or Co to be used as the cathode material has the effect of shielding the externally applied magnetic field so that a magnetic field having a sufficient strength is not provided in the hollow or discharge portion of the cathode. As a result, little or no Zeeman-splitting takes place, thereby remarkably deteriorating the accuracy of measurement. The fact that the externally applied magnetic field cannot be utilized with high efficiency due to the magnetic shielding effect, will give rise to the inconvenience that a magnet of large size must be used to provide a sufficient field strength or a large drive current is required in the case of using an electromagnet.

The present invention is made to eliminate such problems and contemplates the provision of a hollow cathode capable of being used in atomic absorption analysis using the Zeeman effect, in which the externally applied magnetic field can effectively act on the hollow portion of the cathode to provide the desired Zeeman-splitting.

According to one aspect of the present invention, there is provided a hollow cathode used in atomic absorption analysis using the Zeeman effect, wherein the hollow cathode is adapted to be applied with an external magnetic field to cause the Zeeman-splitting of an emission line from the hollow portion of the hollow cathode and the product of the saturation flux density of the materials of the hollow cathode and the volume of the hollow cathode is equal to or smaller than 0.2 $(Wb.m)\times 10^{-6}$.

More particularly, the hollow cathode is made of a first metal including the element of interest for analysis and a second metal for reducing the magnetic shield of the external magnetic field by the first metal. The hollow cathode may be made of an alloy of the first and second metals. Preferably, the alloy is non-magnetic.

According to another aspect of the present invention, there is provided a hollow cathode used in atomic absorption analysis for Fe, Ni and/or Co using the Zeeman effect, wherein the hollow cathode is adapted to be applied with an external magnetic field to cause the Zeeman-splitting of an emission line from the cathode material, the hollow cathode is made of a first metal including at least one of Fe, Ni and Co which is the element of interest for analysis and a second metal for reducing the magnetic shield of the external magnetic field by the first metal, and the product of the saturation flux density of the materials of the hollow cathode and the volume of the hollow cathode is equal to or smaller than 0.2 $(Wb.m)\times 10^{-6}$.

A variety of combinations of the first and second metals are possible. For example, one of Fe, Ni and Co which is the element of interest for analysis, is selected as the first metal and a material other than Fe, Ni and Co is selected as the second metal. In that case, a material which renders the whole hollow cathode as non-magnetic as possible is preferable as the second metal. Examples of such a material are Cr, Cu, Mn, Sn, Si, V, Mo and Ti. The most preferable material is Cr. Also, the first metal may be one of Fe, Ni and Co which is the element of interest for analysis and the second metal may be the other of Fe, Ni and Co. In this case, the second metal can further include a metal material other than Fe, Ni, and Co. Further, the first metal may include all of Fe, Ni and Co. In this case, there are advantages that all of Fe, Ni and Co can be analyzed by use of a single hollow-cathode discharge tube and no exchange of hollow-cathode discharge tubes for individual Fe, Ni, and Co elements of interest for analysis is necessary.

The hollow cathode may be made of an alloy of the first and second metals or may comprise an outer portion made of the second metal, the first metal being provided at least partially on the inner surface of the outer portion of the second metal.

Figure 2:
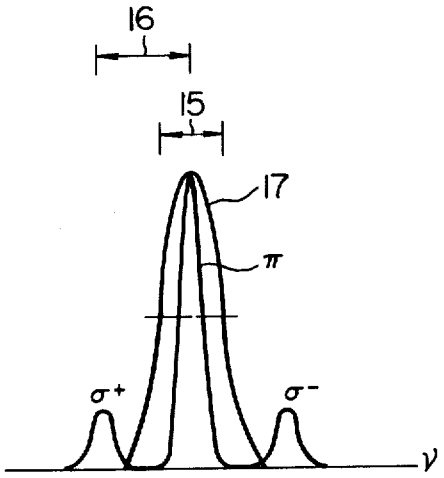
FIG. 2 is a view for explaining the Zeeman-splitting of an emission line.

First, consideration will be made with respect to the intensity of magnetic field necessary for causing the Zeeman-splitting of an emission line from a cathode. In a preferred application of the hollow cathode according to the present invention, an emission line is split into $\pi$ and $\sigma\pm$ components by the Zeeman effect as illustrated in FIG. 2 and analysis is carried out by use of only the emission spectrum line of $\pi$ component. An absorption spectrum 17 of a sample usually has a half-width of about 0.01 Å and the $\sigma\pm$ components of the emission spectrum must be separated from the absorption spectrum 17 to avoid the problem of background correction. The difference in frequency between the $\pi$ component and the $\sigma\pm$ components can be represented by the following equation (1):

$$\Delta\nu(\mathrm{GHz}) = 1.48.g.H \qquad (1)$$

Here, H is magnetic flux density in KG, and g is the Landé factor. This equation is generally described in a Spectrochemica Acta, Vol. 31B, pp 237 to 255, Pergamon Press 1976. Since the half-width of the absorption spectrum 17 of a sample is about 0.01 Å as described above, the separation width $\Delta\nu$ shown by reference numeral 16 in FIG. 2 should be above 0.015 Å. The present inventors have confirmed such a separation width $\Delta\nu$. Namely, for Fe whose Landé factor g is 2.0, the separation width $\Delta\nu$ represented by the equation (1) is 8.8 GHz or 0.017 Å if a magnetic field H of 3 KG effectively acts. For Ni and Co whose Landé factors g are 2.12–2.2, the separation width $\Delta\nu$ is above 0.015 Å if the magnetic field H of 3 KG effectively acts.

From the above description, it will be understood that a magnetic field equal to or greater than 3 KG is required in the hollow space of a hollow cathode in the case of analyzing Fe, Ni or Co and a magnetic field smaller than that requires background correction which is necessary in a usual atomic absorption spectrometry. No problem takes place in the case where an externally applied magnetic field effectively acts intact. However, in the case where a ferromagnetic metal such as Fe, Ni or Co is used as a hollow cathode material, an effective field in the hollow space with respect to the external magnetic field is remarkably decreased due to the magnetic shield of the externally applied magnetic field by the ferromagnetic field. The magnetic field strength available from a usual parallel-gap type magnet arrangement used in atomic absorption spectrometry is at highest about 7 KG if the size and weight of the magnet are taken into consideration. In order to obtain a magnetic field greater than 3 KG within the hollow space, a special contrivance is necessary.

Now, the present invention will be described along some embodiments thereof.

EMBODIMENT 1

By use of vacuum-dissolved materials of Fe, Ni and Co with a purity of 99.99% were prepared one-end closed hollow cathode samples No. 1-1, No. 1-2 and No. 1-3 each of which has the outer diameter of 8 mm, the height of 15 mm, the inner or hollow diameter of 3 mm and the hollow depth of 10 mm. Vacuum-dissolved alloy materials of 90 aromatic % of Fe plus 10 atomic % of Cu, of 90% of Ni plus 10% of Cu and of 90% of Co plus 10% of Cu were made by use of Fe, Ni, Co and Cu with purity of 99.99%. Hollow cathode samples No. 1-4, No. 1-5 and No. 1-6 having the same dimension as the samples No. 1-1, No. 1-2 and No. 1-3 were prepared from these alloy materials. The magnetic field intensity $H_h$ in the hollow space of each cathode sample was measured by means of an electromagnet arrangement having a parallel gap of 20 mm. The measured results are shown in Table I. The external magnetic field $H_e$ applied by the electromagnet was 7 KG.

TABLE I (He: 7 KG)

| Sample No. | Cathode Material | $H_h$ (KG) | $H_h/H_e$ (%) |
|---|---|---|---|
| 1-1 | 100% Fe | 1.8 | 25.8 |
| 1-2 | 100% Ni | 2.7 | 38.6 |
| 1-3 | 100% Co | 2.0 | 28.6 |
| 1-4 | 90% Fe -10% Cu | 3.3 | 47.2 |
| 1-5 | 90% Ni -10% Cu | 4.0 | 57.2 |
| 1-6 | 90% Co -10% Cu | 3.5 | 50.0 |

As seen from the Table I, in the case of each of the 100% Fe, Ni and Co cathodes, a considerable magnetic shielding takes place so that the ratio $H_h/H_e$ is below 40%. As a result, no magnetic field greater than 3 KG is obtained in the hollow space. In the case of each cathode containing 10% of Cu, the ratio $H_h/H_e$ is above 40% so that a magnetic field greater than 3 KG is obtained in the hollow space. The reason why the quantity of Fe, Ni or Co in the sample No. 1-4, No. 1-5 or No. 1-6 is made large, is because a light output intensity necessary as a light source used in atomic absorption analysis can be obtained with a reduced high frequency power input with the lifetime of the light source taken into consideration.

From the Table I, it is also seen that the magnetic shielding effect is greater in the order of Ni, Co and Fe and it will be therefore understood that the quantity of Cu necessary for obtaining the same magnetic field in the hollow space may be made small in the order of Fe, Co and Ni. Further, it will be understood that a threshold quantity of Cu required for obtaining the ratio $H_h/H_e$ of 40% or the magnetic field of 3 KG in the hollow space in the case of the external magnetic field 7 KG is smaller than 10%. The threshold quantity may be changed depending upon the electrode structure, the magnitude of the external magnetic field, etc.

EMBODIMENT 2

Hollow cathode samples No. 2-1 to No. 2-7 respectively containing 100% of Ni, 75 atomic % of Ni plus 25 atomic % of Cu, 70% of Ni plus 30% of Cu, 65% of Ni plus 35% Cu, 50% of Ni plus 50% of Cu, 20% of Ni plus 80% of Cu, and 15% of Ni plus 85% of Cu were prepared with the same dimension as the Embodiment 1. The magnetic field intensity $H_h$ in the hollow space of each cathode sample was measured by means of an electromagnet arrangement having a parallel gap of 20 mm. The external magnetic field $H_e$ applied by the electromagnet was 5 KG. The measured results are shown in FIG. 3. From the figure, it is seen that in the sample No. 2-2 the magnetic shielding effect is high with the ratio $H_h/H_e$ of about 38% so that no magnetic field greater than 3 KG is obtained in the hollow space; in the sample No. 2-3 the magnetic shielding effect is small so that a magnetic field in the hollow space is greater than 3 KG; and in the samples No. 2-4 to No. 2-7 no or less magnetic shielding effect takes place so that a magnetic field approximately equal to the externally applied magnetic field 5 KG is obtained in the hollow cathode.

FIG. 4 shows the measured light output intensity of Ni emission line of wavelength 232.0 nm, when a high frequency power input of 20 W is applied to the discharge tubes in which the above cathode samples are sealed. In the figure, the abscissa represents the quantity of Ni or Cu and the ordinate represents the relative light output intensity. The relative values of light output intensity are shown such that the value for the sample No. 2-7 is 10. It is known that a relative light output intensity necessary for the use of the cathode sample as a light source is practical if it is above 25. From FIG. 4, it is seen that the cathode containing 85% of Cu has a poor light output intensity but the cathodes containing 80% or less than 80% of Cu can provide practically useful light output intensities.

From FIGS. 3 and 4, it will be understood that if the quantity of Cu is 30%-80% in the Ni-Cu alloy cathode, a magnetic field sufficient for causing the Zeeman-splitting can be obtained in the hollow space and a practically useful light output intensity can be provided. It should be noted that the specified range for the quantity of Cu is an example. Namely, since the lower limit may change depending upon the magnitude of an externally applied magnetic field and the dimensions of the electrode and the upper limit may change depending upon the dimensions of the electrode, the range of the quantity of Cu is determined in accordance with those factors.

EMBODIMENT 3

There were prepared hollow cathodes each of which includes a Fe electrode portion 3' of a thickness t made of Fe with a purity of 99.99% and an outer portion 3'' made of Cu with a purity of 99.99%, as is shown in FIG. 5. Namely, one-end closed hollow Fe electrode portions 3' respectively having the outer diameters of 5, 4 and 3.6 mm. the heights of 11, 10.5 and 10.3 mm, the inner or hollow diameters of 3 mm, the hollow depths of 10 mm, and the thicknesses of 1.0, 0.5 and 0.3 mm were fabricated. The outer portions 3'' of Cu as a non-magnetic material were attached around the Fe electrode portions 3' respectively so that hollow cathode samples No. 3-2, No. 3-3 and No. 3-4 having the same dimension as the Embodiment 1 are provided. The magnetic field intensity $H_h$ in the hollow space of each cathode sample was measured by means of an electromagnet arrangement having a parallel gap of 20 mm. The externally applied magnetic field $H_e$ from the electromagnet was 7 KG. The measured results are shown in Table II. Sample No. 3-1 shown in the Table includes no outer portion 3'' of Cu.

TABLE II

| Sample No. | t (mm) | $H_h$(KG) | $H_h$/He (%) | (He: 7 KG) $t \times \frac{H_h \times 10^3}{H_e}$ |
|---|---|---|---|---|
| 3-1 | 2.5 | 1.8 | 25.8 | 654 |
| 3-2 | 1.0 | 2.65 | 37.9 | 379 |
| 3-3 | 0.5 | 3.5 | 50.0 | 250 |
| 3-4 | 0.3 | 4.0 | 57.2 | 171 |

From the Table II, it is seen that each cathode sample having the Fe electrode portion thickness t equal to or larger than 1.0 mm has a great magnetic shielding effect to provide an insufficient Zeeman-splitting and each cathode sample having the thickness t equal to or smaller than 0.5 mm has the effect of reducing the magnetic shielding so that a magnetic field greater than 3 KG is obtained in the hollow space.

The last column of the Table II shows the product of the thickness t (mm) of the Fe electrode portion 3' and the saturation magnetization ($H_h \times 10^3$ gauss) of the entire hollow cathode, in terms of the product value per 1 KG of the externally applied magnetic field $H_e$. It is seen that the product value smaller than about 300 can provide a hollow space magnetic field greater than 3 KG.

FIGS. 6 and 7 show structures in which the magnetic-shield reducing effect by the outer portion of Cu as a non-magnetic material is further improved. In FIG. 6, the Fe electrode portion 3'-1 is partially provided on the inner surface of the outer portion 3''-1 of Cu. In FIG. 7, the Fe electrode portion 3'-2 is provided on the whole inner surface of the outer portion 3''-2 of Cu, thereby enlarging the area of the Fe electrode surface in comparison with the structure of FIG. 6.

EMBODIMENT 4

The same measurement of a hollow space magnetic field $H_h$ as made with respect to the Embodiment 1 was carried out to hollow cathode samples No. 4-1 to No. 4-9 of alloys made from various combinations of some metals in wieght % as shown in Table III. The used external magnetic field $H_e$ was 7 KG. It was found that all the samples shown in the Table exhibit the ratio $H_h/H_e$ greater than 40% and provide a great Zeeman-splitting effect.

TABLE III

| Sample No. | Fe (%) | Ni (%) | Co (%) | Cr (%) |
|---|---|---|---|---|
| 4-1 | 70 | 30 | | |
| 4-2 | 55 | 20 | | 25 |
| 4-3 | 20 | | 50 | 30 |
| 4-4 | | 80 | | 20 |
| 4-5 | | | 80 | 20 |
| 4-6 | 50 | | | 50 |
| 4-7 | 72 | 10 | | 18 |
| 4-8 | 30 | 45 | | 25 |
| 4-9 | 35 | 25 | 25 | 15 |

From the Table III, i is understood that a cathode containing two metals of Fe, Ni and Co or a cathode containing at least two metals of Fe, Ni and Co and further containing Cr is useful. The cathode containing two metals of Fe, Ni and Co has an advantage that two of Fe, Ni and Co can be analyzed by use of a single hollow-cathode discharge tube including said cathode.

A cathode such as the sample No. 4-9 containing all of Fe, Ni and Co can provide a remarkably useful light source having advantages that all of Fe, Ni and Co can be analyzed by use of a single hollow-cathode discharge tube and no exchange of hollow-cathode discharge tubes for individual Fe, Ni and Co elements of interest for analysis is necessary. The reason why the quantity of Fe in the sample No. 4-9 is made great in comparison with that of Ni or Co, is because Fe is sputtered with a degree lower than Ni and Co at the time of operation and hence the light output intensity of a light source is taken into consideration.

EMBODIMENT 5

By the same manner as the Embodiment 3, hollow cathode samples No. 5-2, No. 5-3 and No. 5-7 were prepared with the same dimensions as those shown in FIG. 5. The thicknesses t of Fe electrode portions 3' of the samples No. 5-2, No. 5-3 and No. 5-7 were 0.2 mm, 0.4 mm and 0.75 mm respectively. Samples No. 5-1, No. 5-4, No. 5-5 and No. 5-6 were made of only Cu, only Ni, only Co and only Fe respectively, each of these samples having the outer diameter of 5 mm, the height of 11 mm, the inner or hollow diameter of 3 mm and the hollow depth of 10 mm. By using the samples No. 5-1 to No. 5-7, the magnetic field intensity $H_h$ in the hollow space of each sample was measured in the same manner as in the Embodiment 3 with the external magnetic field of 7 KG.

FIG. 8 shows the measured relationship between the product of the saturation flux density or saturation induction B (Wb/m$^2$) of the materials of the cathode and the volume V (m$^3$) of the cathode (Wb·m$\times 10^{-6}$) and the magnetic field intensity in the hollow space of the cathode. The volume V of the cathode excludes the hollow space of the cathode. By using the above-mentioned dimensions, the volume V is about $0.022\times 10^{-6}$ m$^3$ for the sample No. 5-2, about $0.047\times 10^{-6}$ m$^3$ for the sample No. 5-3, about $0.099\times 10^{-6}$ m$^3$ for the sample No. 5-7 and about $0.14\times 10^{-6}$ m$^3$ for the samples No. 5-1, No. 5-4, No. 5-5 and No. 5-6. By further using the value of saturation magnetic-flux density B (2.12 Wb/m$^2$ for Fe, 0.61 Wb/m$^2$ for Ni and 1.79 Wb/m$^2$ for Co), the value $B\times V$ in $10^{-6}$ Wb·m is 0 for the sample No. 5-1, about 0.047 for the sample No. 5-2, about 0.099 for the sample No. 5-3, about 0.084 for the sample No. 5-4, about 0.241 for the sample No. 5-5, about 0.297 for the sample No. 5-6 and about 0.217 for the sample No. 5-7. From FIG. 8, it is seen that the magnetic field intensity in the hollow space remarkably increases by rendering the product $B\times V$ equal to or smaller than 0.2 (Wb·m)$\times 10^{-6}$. Namely, in the analysis for a ferromagnetic material the external magnetic field can effectively act on the hollow space of the cathode if the product $B\times V$ equal to or smaller than 0.2 (Wb·m)$\times 10^{-6}$ is satisfied in the cathode.

EMBODIMENT 6

FIGS. 9A and 9B show the relationships between the absorbance sensitivity of the $\pi-\sigma$ (true atomic-absorption signal) component and the quantity of Cd, Zn, Mn, Ag, Cr, Cu, Fe and Pb which were obtained by using various cathode electrodes of Cd, Zn, Mn, Ag, Cr, Cu, AISI310S, Fe and Pb in the Zeeman effect atomic absorption analyzer shown in FIG. 1. The dimensions of the used cathode electrodes were the same as those used in the Embodiments 1. The used external magnetic field was 6.4 KG and a high frequency power source of 100 MHz and about 8 was used. An air-acetylene burner was used in the atomizer. The pure Fe electrode was employed for comparison. As seen from FIGS. 9A and 9B, the absorbance in the case of the pure Fe electrode is very low and the AISI310 electrode provides an excellent absorbance. Further, it is seen that the other electrodes provide good absorbance.

In the above-described embodiments, there have been examples of cathode in which Cr or Cu is added to Fe, Ni and/or Co. However, any suitable metal which may reduce the magnetic shielding effect by Fe, Ni and Co can be used. The present inventors have found out that Mn, Sn, Si, V, Mo and Ti are useful in addition to Cr and Cu and the most preferable metal is Cr. It is of course that the combination of two or more of those metals is also useful in accordance with the present invention.

In the case where a hollow cathode containing 100% of Fe, Ni or Co is used and an external magnetic field as great as several tens of KG is applied, a magnetic field greater than 3 KG necessary for the Zeeman-splitting may be obtained in the hollow space notwithstanding a possible magnetic-shielding effect. In that case, however, a large-sized and expensive magnet must be used or in a large drive current is required in the case of an electromagnet, and a special support for a cathode must be designed since the cathode is strongly attached to the magnet. Even in such a case, the use of the present invention can provide a utilization of an externally applied magnetic field with high efficiency so that the size of a magnet and/or a drive current may be reduced.

Though the analysis in the system shown in FIG. 1 has been carried out by means of only the spectral line of the $\pi$ component, it is of course obvious that the present invention is applicable to a system which uses one of either $\pi$ or $\sigma$ components as an absorbing light and the other as a reference light. Optics and detector arrangement of such a system is shown, for example, in the above-cited Spectrochimica Acta, Vol. 31B, pp. 237 to 255, especially p. 242.

We claim:

1. A light source used in atomic absorption analysis for Fe, Ni and/or Co using the Zeeman effect, comprising an electrode having a hollow portion, which hollow portion has electrode material of said electrode adjacent thereto, whereby during said analysis the electrode material is spattered and an emission line of said electrode material is produced in the hollow portion by high frequency excitation, and an external magnetic field applying means for applying an external magnetic field to the hollow portion of said electrode to cause the Zeeman-splitting of the emission line from the electrode material, wherein said electrode is made of a first metal including at least one of Fe, Ni and Co which is the element of interest for analysis and a second metal for reducing the magnetic shield of said external magnetic field by said first metal, said electrode material adjacent said hollow portion including said first metal, whereby the second metal acts to sufficiently reduce the magnetic shielding of the hollow portion due to the first metal such that the external magnetic field can provide Zeeman-splitting of said emission line.

2. A light source according to claim 1, wherein said second metal includes at least one of Cr, Cu, Mn, Sn, Si, V, Mo and Ti.

3. A light source according to claim 1, wherein said first metal includes one of Fe, Ni and Co and said second metal includes at least one of the other of Fe, Ni and Co.

4. A light source according to claim 3, wherein said second metal further includes at least one of Cr, Cu, Mn, Sn, Si, V, Mo and Ti.

5. A light source according to claim 1, wherein said first metal includes all of Fe, Ni and Co, whereby said light source can be used for the analysis for all of Fe, Ni and Co.

6. A light source according to claim 5, wherein said first metal includes at least one of Cr, Cu, Mn, Sn, Si, V, Mo and Ti.

7. A light source according to claim 1, wherein said electrode is made of an alloy of said first and second metals.

8. A light source according to claim 1, wherein the quantity of said second metal is selected so that the entire electrode is non-magnetic.

9. A light source used in atomic absorption analysis is for Fe, Ni and/or Co using the Zeeman effect, comprising an electrode having a hollow portion, which hollow portion has electrode material of said electrode adjacent thereto, whereby during said analysis the electrode material is spattered and an emission line is produced in the hollow portion by high frequency excitation, and an external magnetic field applying means for applying an external magnetic field to the hollow portion of said electrode to cause the Zeeman-splitting of the emission line from the electrode material, wherein said electrode is made of a first metal including at least one of Fe, Ni and Co which is the element of interest for analysis and a second metal for reducing the magnetic shield of said external magnetic field by said first metal, said electrode material adjacent said hollow portion including said first metal, and the product of the saturation flux density of the materials of the electrode and the volume of said electrode excluding the hollow portion is equal to or smaller than 0.2 $(Wb \cdot m) \times 10^{-6}$, whereby the second metal acts to sufficiently reduce the magnetic shielding of the hollow portion due to the first metal such that the external magnetic field can provide Zeeman-splitting of said emission line.

10. A light source according to claim 9, wherein said second metal includes at least one of Cr, Cu, Mn, Sn, Si, V, Mo and Ti.

11. A light source according to claim 9, wherein said first metal includes one of Fe, Ni and Co and said second metal includes at least one of the other of Fe, Ni and Co and further includes at least one of Cr, Cu, Mn, Sn, Si, V, Mo and Ti.

12. A light source used in atomic absorption analysis using the Zeeman effect, comprising an electrode having a hollow portion, which hollow portion has electrode material of said electrode adjacent thereto, whereby during said analysis the electrode material is spattered and an emission line is produced by high frequency excitation, and an external magnetic field applying means for applying an external magnetic field to the hollow portion of said electrode to cause the Zeeman-splitting of the emission line from the electrode material, wherein said electrode includes an outer portion of non-magnetic material and an inner portion of ferromagnetic material as the element of interest for analysis provided at least partially on the inner surface of said outer portion, said electrode material adjacent said hollow portion including said ferromagnetic material, whereby the non-magnetic material acts to sufficiently reduce the magnetic shielding of the hollow portion due to the ferromagnetic material such that the external magnetic field can provide Zeeman-splitting of said emission line.

13. A light source according to claim 12, wherein the ferromagnetic material is provided on the entire inner surface of said outer portion.

14. A light source according to claim 13, wherein the ferromagnetic material provided on the entire inner surface of said outer portion has a variable thickness.

15. A light source used in atomic absorption analysis using the Zeeman effect, comprising an electrode having a hollow portion, which hollow portion has electrode material of said electrode adjacent thereto, whereby during said analysis the electrode material is spattered and an emission line is produced by high frequency excitation, and an external magnetic field applying means for applying an external magnetic field to the hollow portion of said electrode to cause the Zeeman-splitting of the emission line from the electrode material, wherein said electrode is made of a ferromagnetic material as the element of interest for analysis and of a non-magnetic material, said electrode material adjacent said hollor portion including said ferromagnetic material, whereby the non-magnetic material acts to sufficiently reduce the magnetic shielding of the hollow portion due to the ferromagnetic material such that the external magnetic field can provide Zeeman-splitting of said emission line.

16. A light source according to one of claims 1, 9, 12 or 15, further including another electrode of opposite polarity to said electrode.

17. A light source according to claim 16, wherein said electrode is a cathode and said another electrode is an anode.

18. A light source according to claim 16, further including a tube containing said electrode and said another electrode, said external magnetic field applying means being outside of said tube.

19. A light source according to claim 18, wherein said tube is filled with a discharge maintaining inert gas.

20. A light source according to claim 19, further comprising high frequency power supply means for ionizing the inert gas and for producing the emission line, said high frequency power supply means being connected to said electrode and said another electrode.

21. A light source according to claim 12, wherein the product of the saturation flux density of the materials of the electrode and the volume of the electrode excluding the hollow portion is equal to or smaller than 0.2 $(Wb \cdot m) \times 10^{-6}$.

22. A light source according to claim 13, wherein the ferromagnetic and non-magnetic materials are Fe and Cu, respectively, and the product of the saturation flux density of the materials of the electrode and the volume of the electrode excluding the hollow portion is equal to or smaller than 0.2 $(Wb \cdot m) \times 10^{-6}$.

* * * * *